US010874281B2

(12) United States Patent
Durham et al.

(10) Patent No.: US 10,874,281 B2
(45) Date of Patent: Dec. 29, 2020

(54) DISHWASHER APPLIANCE EQUIPPED WITH FLOOD PROTECTION

(71) Applicant: Haier US Appliance Solutions, Inc., Wilmington, DE (US)

(72) Inventors: Kyle Edward Durham, Louisville, KY (US); Craig Curtis, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 357 days.

(21) Appl. No.: 15/935,156

(22) Filed: Mar. 26, 2018

(65) Prior Publication Data

US 2019/0290096 A1 Sep. 26, 2019

(51) Int. Cl.
*A47L 15/42* (2006.01)

(52) U.S. Cl.
CPC ..... *A47L 15/421* (2013.01); *A47L 15/4223* (2013.01); *A47L 15/4244* (2013.01); *A47L 15/4246* (2013.01); *A47L 2401/06* (2013.01); *A47L 2401/09* (2013.01); *A47L 2401/22* (2013.01)

(58) Field of Classification Search
CPC ..... A47L 15/421; A47L 15/4223; A47L 15/4244; A47L 15/4246; A47L 2401/06; A47L 2401/09; A47L 2401/22
USPC ..... 134/57 D
See application file for complete search history.

(56) References Cited

U.S. PATENT DOCUMENTS

| | | | |
|---|---|---|---|
| 8,702,874 B2 | 4/2014 | Montgomery et al. | |
| 2010/0175718 A1 | 7/2010 | Kedjierski et al. | |
| 2012/0199162 A1* | 8/2012 | Montgomery | A47L 15/0049 134/18 |
| 2013/0008477 A1 | 1/2013 | Forst et al. | |

FOREIGN PATENT DOCUMENTS

| | | |
|---|---|---|
| CN | 100588362 C | 2/2010 |
| DE | 10246016 A1 | 4/2004 |

* cited by examiner

*Primary Examiner* — Tinsae B Ayalew
(74) *Attorney, Agent, or Firm* — Dority & Manning, P.A.

(57) ABSTRACT

A dishwasher appliance equipped with flood protection features that proactively attempt to prevent, stop, and/or mitigate flood events is provided. The dishwasher appliance may also include features for determining the cause of the flood event. Moreover, methods for flood protection of the dishwasher appliance are also provided.

18 Claims, 6 Drawing Sheets

DISHWASHER APPLIANCE EQUIPPED WITH FLOOD PROTECTION

FIELD OF THE INVENTION

The present disclosure relates generally to dishwasher appliances, and more particularly to dishwasher appliances having flood detection features.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with a circulation pump for circulating fluid through the multiple spray assemblies.

Under certain conditions, dishwasher appliances are prone to flooding over a tub lip of the tub. For instance, dishwasher appliances may be prone to flooding over the tub lip during an out-of-level condition, an inlet water valve failure, and/or a drain pump failure. When one or more of such conditions occur, the water level can rise above the designed fill level and spill over the tub lip and onto the floor. This may be detrimental to consumers' homes.

Some conventional dishwasher appliances include features for detecting tub overfills or flood events. For example, some dishwasher appliances include float sensors for detecting such flood events. While flood detection features of conventional dishwasher appliances are capable of detecting such flood events, the feedback from such detection features is generally not used proactively to attempt to stop the flood event or mitigate the flood damage. Moreover, generally no information as to the source of the flood event is provided to service professionals.

Accordingly, a dishwasher appliance that includes flood prevention and protection features and methods therefore that address one or more of the challenges noted above would be useful.

BRIEF DESCRIPTION OF THE INVENTION

The present disclosure provides a dishwasher appliance equipped with flood protection features that proactively attempt to prevent, stop, or mitigate flood events. The dishwasher appliance may also include features for determining the cause of the flood event. Moreover, methods for flood protection of the dishwasher appliance are also provided. Additional aspects and advantages of the invention will be set forth in part in the following description, may be apparent from the description, or may be learned through practice of the invention.

In accordance with one exemplary embodiment, a method for flood protection of a dishwasher appliance is provided. The dishwasher appliance includes a drain pump, a cabinet, and a tub positioned within the cabinet. The tub has a tub lip. The method includes determining whether wash fluid is present at or proximate the tub lip at a first time; activating the drain pump to run a drain cycle if wash fluid is present at or proximate the tub lip at the first time; ascertaining whether a current time is greater than or equal to a predetermined drain time; determining whether wash fluid is present at or proximate the tub lip at a second time if the current time is greater than or equal to the predetermined drain time; and pulsing the drain pump if wash fluid is present at or proximate the tub lip at the second time.

In accordance with another exemplary embodiment, a method for flood protection of a dishwasher appliance is provided. The dishwasher appliance includes a drain pump, a water inlet valve, a cabinet, and a tub positioned within the cabinet. The tub has a tub lip. The method includes determining whether wash fluid is present at or proximate the tub lip at a first time; activating the drain pump to run a drain cycle if wash fluid is present at or proximate the tub lip at the first time; ascertaining whether a current time is greater than or equal to a predetermined drain time; determining whether wash fluid is present at or proximate the tub lip at a second time if the current time is greater than or equal to the predetermined drain time; deactivating the drain pump if wash fluid is not present at or proximate the tub lip at the second time; ascertaining if a count is greater than or equal to a count threshold; and pulsing the water inlet valve if wash fluid is present at or proximate the tub lip if the count is greater than or equal to the count threshold.

In accordance with yet another exemplary embodiment, a dishwasher appliance is provided. The dishwasher appliance includes a cabinet and a tub positioned within the cabinet. The tub defining a wash chamber for receipt of articles for washing. The tub has a tub lip. The dishwasher appliance further includes a tub lip sensor mounted on the tub lip and configured to detect wash fluid at or proximate the tub lip. In addition, the dishwasher appliance includes a water inlet valve for selectively allowing wash fluid into the wash chamber. Further, the dishwasher appliance includes a drain pump for draining wash fluid from the tub. Moreover, the dishwasher appliance includes a controller communicatively coupled with the tub lip sensor, the water inlet valve, and the drain pump, the controller configured to: determine, at a first time, whether the tub lip sensor has sensed wash fluid at or proximate the tub lip for a predetermined time; activate the drain pump to run a drain cycle if wash fluid is present at or proximate the tub lip at the first time; ascertain whether a current time is greater than or equal to a predetermined drain time; determine, at a second time, whether the tub lip sensor has sensed wash fluid at or proximate the tub lip for a predetermined time if the current time is greater than or equal to the predetermined drain time; and i) wherein if wash fluid is present at or proximate the tub lip at the second time: ascertain whether a pulse flag is less than or equal to a pulse threshold; and pulse the drain pump if the pulse flag is less than or equal to the pulse threshold; or ii) wherein if wash fluid is not present at or proximate the tub lip at the second time: deactivate the drain pump; ascertain whether a current count is greater than or equal to a count threshold; and pulse the water inlet valve if the current count is greater than or equal to the count threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
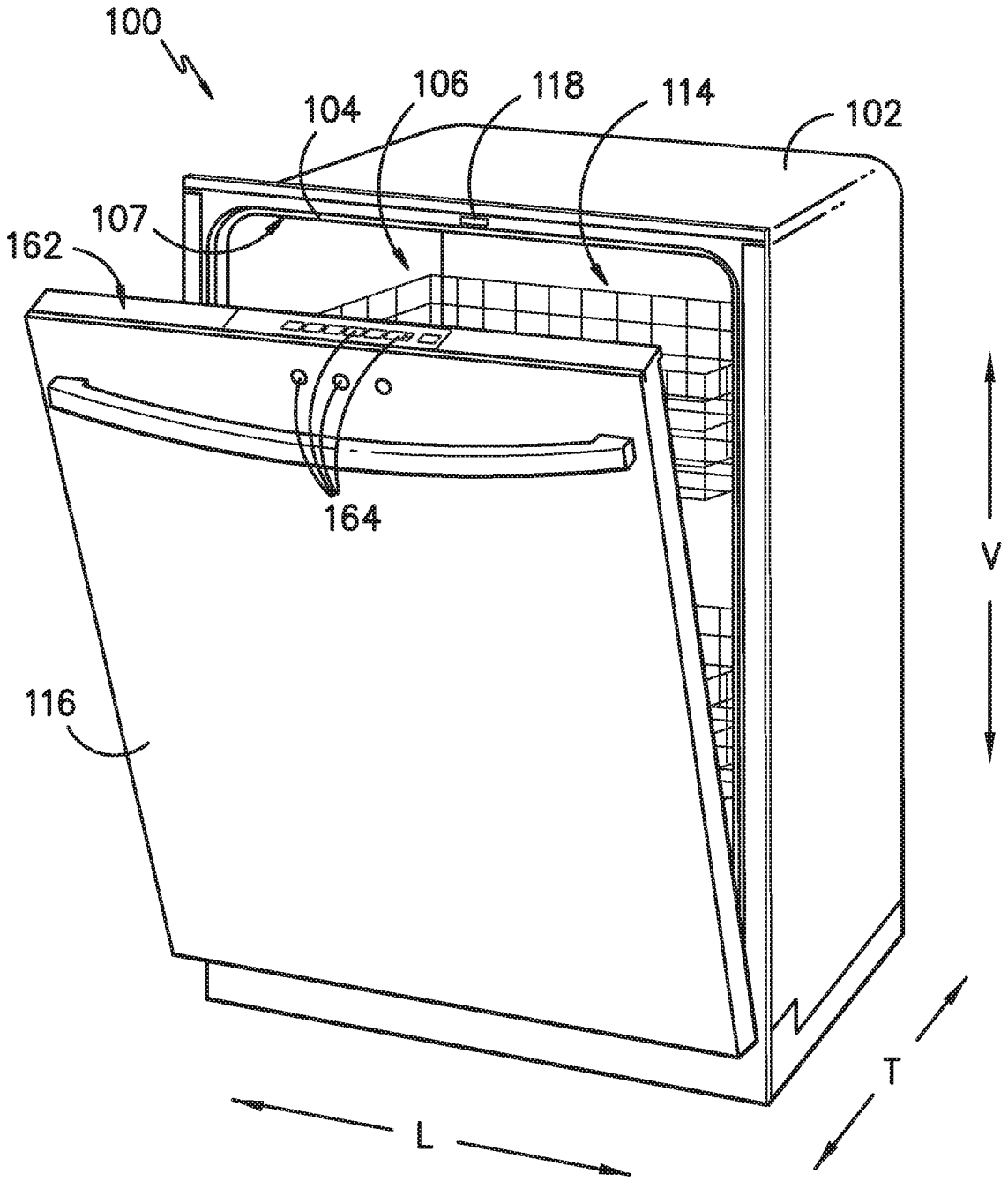
FIG. 1 provides a perspective view of an exemplary embodiment of a dishwasher appliance of the present disclosure with a door in a partially open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent (10%) margin of error.

Figure 2:
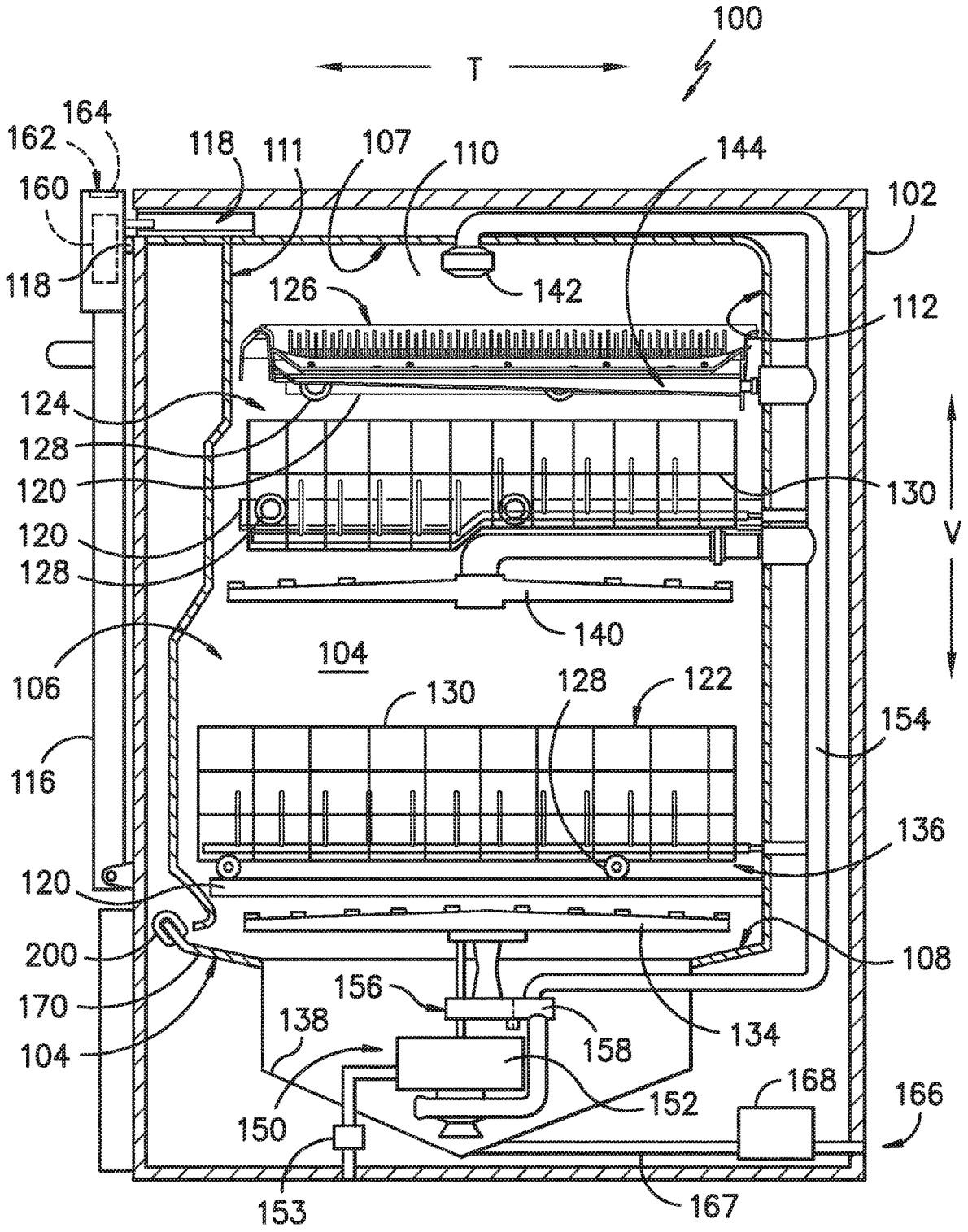
FIG. 2 provides a side, cross sectional view of the exemplary dishwasher appliance of FIG. 1.

FIGS. 1 and 2 depict an exemplary dishwasher appliance 100 that may be configured in accordance with aspects of the present disclosure. For the particular embodiment of FIGS. 1 and 2, dishwasher 100 defines a vertical direction V, a lateral direction L, and a transverse direction T. Each of the vertical direction V, lateral direction L, and transverse direction T are mutually perpendicular to one another and form an orthogonal direction system. Dishwasher 100 includes a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 (FIG. 1) and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. Dishwasher 100 includes a door closure mechanism or assembly 118 that is used to lock and unlock door 116 for accessing and sealing wash chamber 106.

As further shown in FIG. 2, tub side walls 110 accommodate a plurality of rack assemblies. More specifically, guide rails 120 are mounted to side walls 110 for supporting a lower rack assembly 122, a middle rack assembly 124, and an upper rack assembly 126. Upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to other exemplary embodiments, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 is generally configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in tub 104. More specifically, fluid circulation assembly 150 includes a circulation pump 152 for circulating water and wash fluid (e.g., detergent, water, and/or rinse aid) in tub 104. Circulation pump 152 is located within sump 138 or within a machinery compartment located below sump 138 of tub 104. Circulation pump 152 is in fluid communication with an external water supply line (not shown) and sump 138. A water inlet valve 153 is positioned between the external water supply line and circulation pump 152 to selectively allow water to flow from the external water supply line to circulation pump 152. Additionally or alternatively, water inlet valve 153 may be positioned between the external water supply line and sump 138 to selectively allow water to flow from the external water supply line to sump 138. Water inlet valve 153 may be an electro-mechanical valve that can be selectively controlled to open to allow the flow of water into dishwasher 100 and can be selectively controlled to cease the flow of water into dishwasher 100. Further, fluid circulation assembly 150 may include one or more fluid conduits or circulation piping for directing water and/or wash fluid from circulation pump 152 to the various spray assemblies and manifolds. For example, for the embodiment depicted in FIG. 2, a primary supply conduit 154 extends from circulation pump 152, along rear 112 of tub 104 along the vertical direction V to supply wash fluid throughout wash chamber 106.

As further illustrated in FIG. 2, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, circulation pump 152 draws wash fluid in from sump 138 and pumps it to a diverter 156, e.g., which is positioned within sump 138 of dishwasher appliance. Diverter 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter 156 is configured for selectively distributing the flow of wash fluid from circulation pump 152 to various fluid supply conduits, only some of which are illustrated in FIG. 2 for clarity. More specifically, diverter 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, e.g., such as primary supply conduit 154.

Drainage of soiled water within sump 138 may occur, for example, through drain assembly 166. In particular, water may exit sump through a drain and may flow through a drain conduit 167. A drain pump 168 may facilitate drainage of the soiled water by pumping the water to a drain line external to the dishwasher 100.

Dishwasher 100 is further equipped with a controller 160 to regulate operation of dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

With reference still to FIG. 2, in some instances, dishwasher 100 may experience a tub overfill or flood event, e.g., when wash fluid spills over a tub lip 170 of tub 104. Such an overfill or flood event can occur as a result of any number of conditions or failures, such as e.g., an out-of-level condition, an inlet water valve failure, and/or a drain pump failure. To detect such flood events, dishwasher 100 may include various sensors that provide feedback to controller 160 such that corrective action may be taken. More particularly, as shown in the depicted embodiment of FIG. 2, dishwasher 100 includes a tub lip sensor 200 positioned on or mounted to tub lip 170. Tub lip sensor 200 is configured to detect wash fluid at or proximate tub lip 170. Accordingly, in accordance with exemplary aspects of the present disclosure, dishwasher 100 may utilize feedback from tub lip sensor 200 for flood protection of dishwasher appliance 100.

Figure 3:
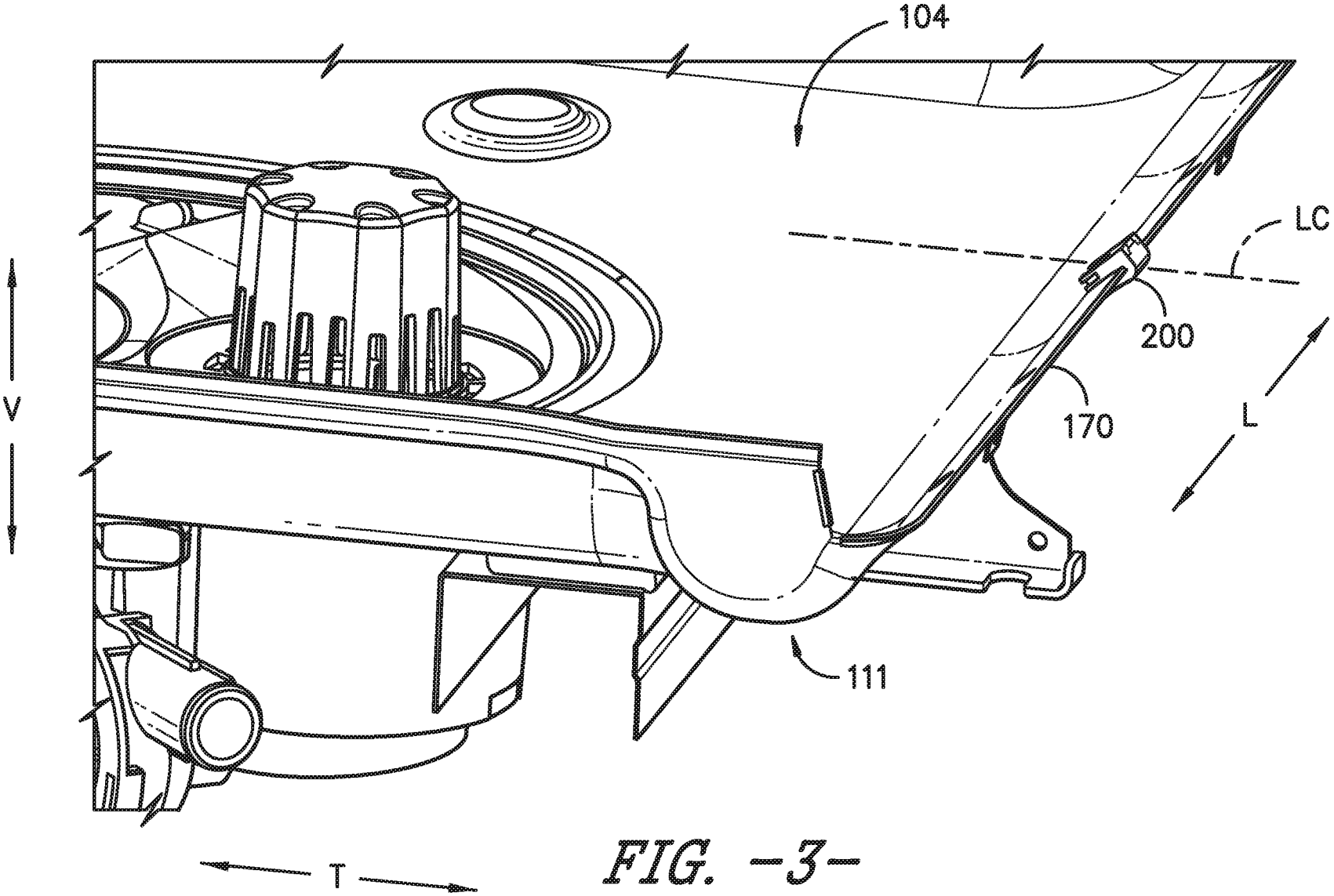
FIG. 3 provides a perspective view of an exemplary tub lip sensor mounted with a tub lip of a tub of the dishwasher appliance of FIGS. 1 and 2.

FIG. 3 provides a perspective view of tub lip sensor 200 mounted or attached to tub lip 170 of tub 104 of the dishwasher appliance 100 of FIGS. 1 and 2. As noted above, tub lip sensor 200 is operatively configured to detect high water or wash fluid levels within tub 104, and more particularly, tub lip sensor 200 is configured to sense wash fluid that is at or proximate tub lip 170. Tub lip sensor 200 is communicatively coupled with controller 160 and may communicate with controller 160 via one or more signals. In this way, appropriate action can be taken to prevent an overfill or flood event.

Notably, for the depicted embodiment of FIG. 3, tub lip sensor 200 is positioned on or mounted to tub lip 170 of tub 104, and more particularly, tub lip sensor 200 is positioned on or mounted to tub lip 170 at front side 111 of tub 104 for this embodiment. By positioning tub lip sensor 200 at or on tub lip 170, tub lip sensor 200 does not interfere with the water flow through sump 138 during wash or drain cycles and takes up a minimal amount of space. In addition, by placing tub lip sensor 200 at front side 111 of tub 104, tub lip sensor 200 is advantageously positioned to detect water spillage or floods over the front portion of tub 104, which is a location where water is likely to spill or flood onto the floor of a consumer's home in the event of a water breach over this portion of tub 104. Further, for this embodiment, tub lip sensor 200 is positioned approximately along a lateral centerline LC that extends along the transverse direction T midway along the lateral length of tub 104. In this way, tub lip sensor 200 may still detect high wash fluid levels during out-of-level conditions, e.g., tilting of the dishwasher 100 about the transverse direction T.

In the depicted embodiment of FIG. 3, tub lip sensor 200 is a conductivity sensor. That is, when water or wash fluid fills up to tub lip 170, the wash fluid bridges leads or electrical contacts of tub lip sensor 200 thus allowing an electrical current to travel from one lead to the other. This completes a circuit that includes the electrical leads of tub lip sensor 200 and controller 160, among other possible electrical components. The change or increase in electrical current through the circuit is indicative that wash fluid is present or sensed at tub lip 170. The change in electrical current through the circuit can be measured by any suitable parameter (e.g., a change in current, voltage, or resistance) and by any suitable device (e.g., a multimeter positioned within controller 160).

Figure 4A:
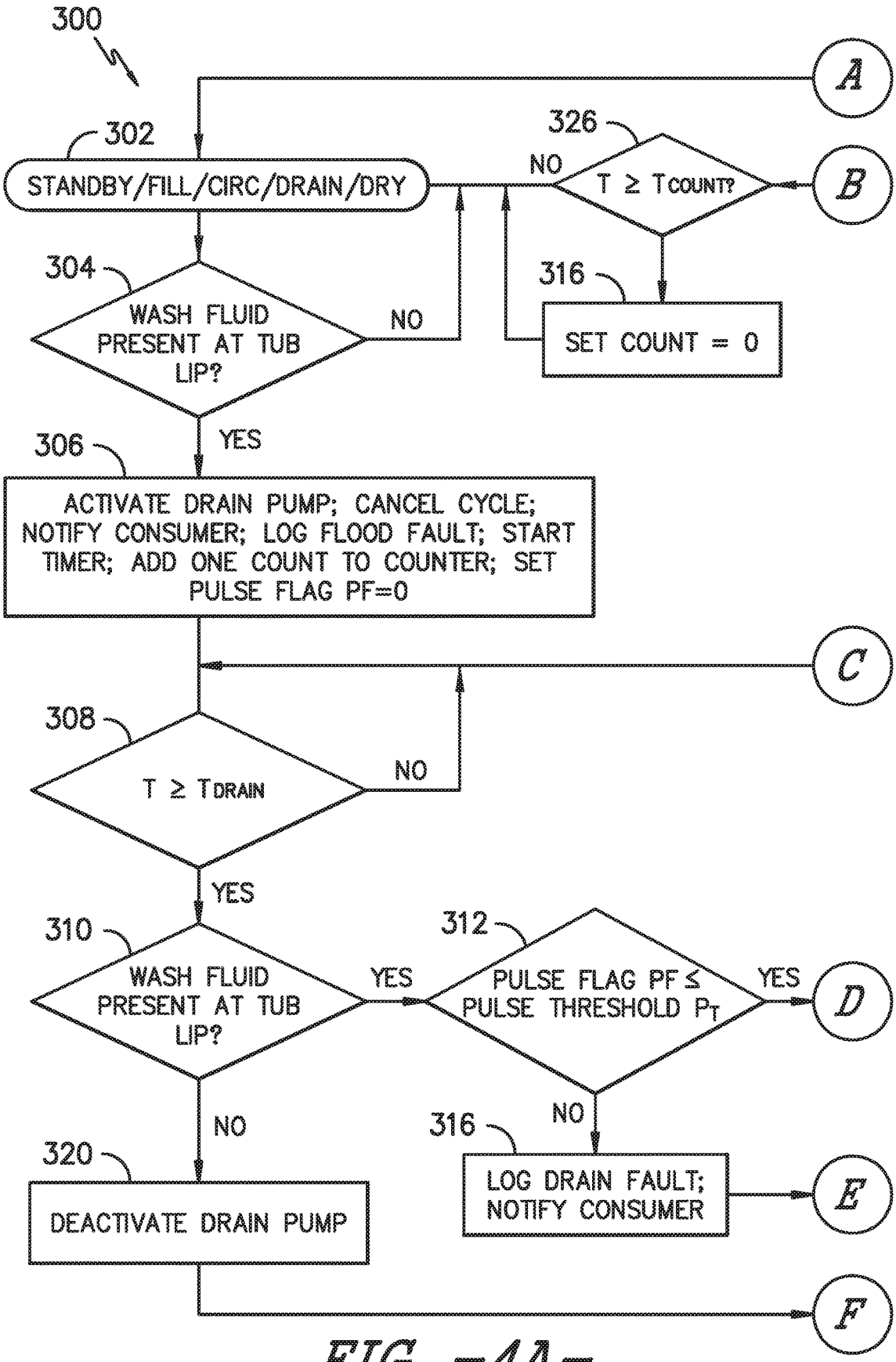
FIGS. 4A and 4B provide a flow diagram of an exemplary method for flood protection of a dishwasher appliance according to exemplary embodiments of the present disclosure.
Figure 4B:
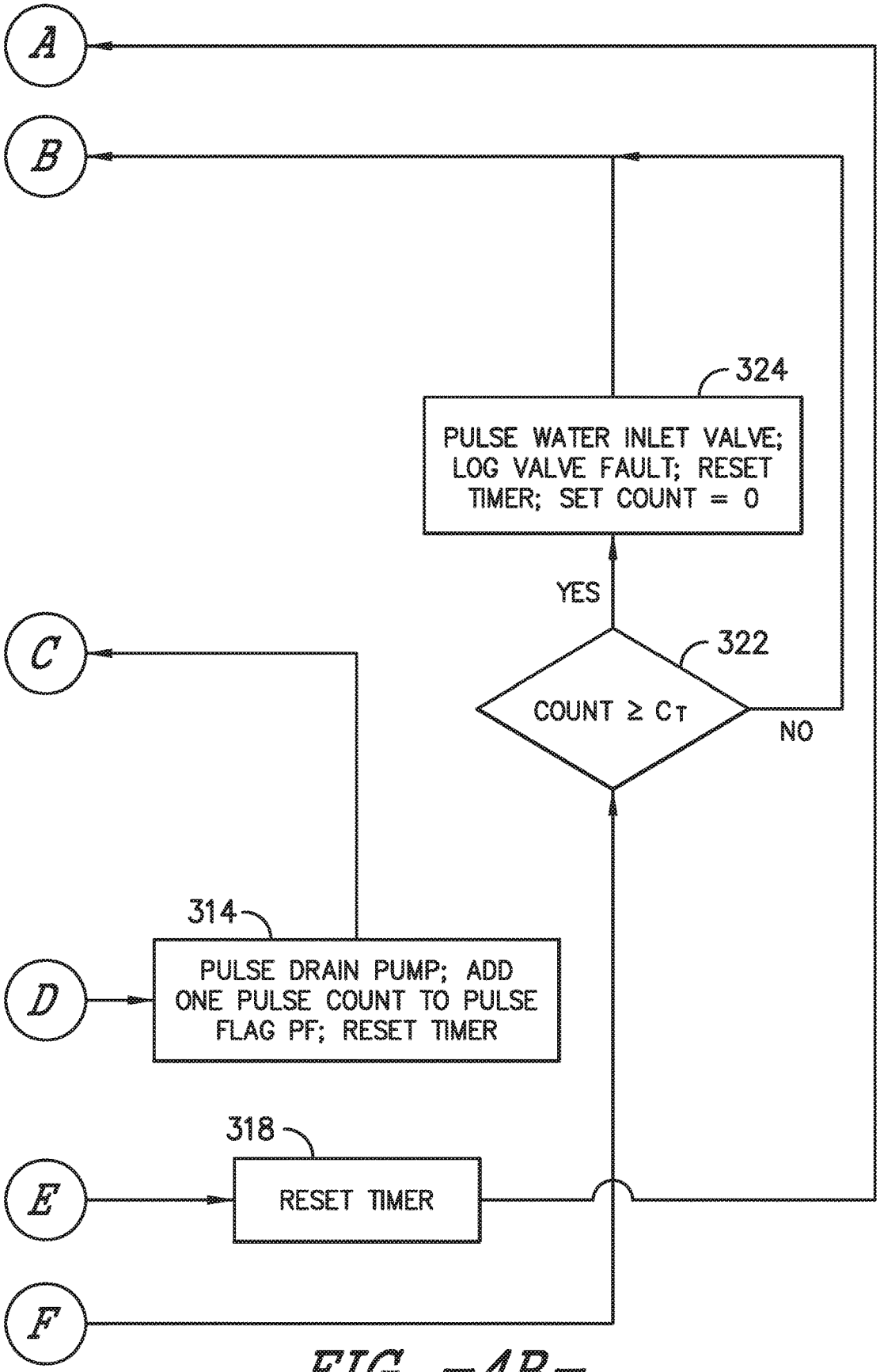

FIGS. 4A and 4B provide a flow diagram of an exemplary method (300) for flood protection of a dishwasher appliance according to exemplary embodiments of the present disclosure. For instance, the method (300) can be used for flood protection of the dishwasher appliance 100 of FIGS. 1 and 2. Further, as will be explained below, outputs of the tub lip sensor 200 of FIGS. 2 and 3 can be utilized to detect flood events of dishwasher 100. To provide context to exemplary method (300), the reference numerals used in FIGS. 1 through 3 to describe the features of dishwasher 100 will be used below. It will be appreciated, however, that method (300) is not limited in scope to dishwasher 100 of FIGS. 1 through 3; rather, method (300) is applicable to other suitable types and models of dishwashers.

At (302), method (300) includes powering up or operating a dishwasher. For instance, dishwasher 100 can be powered in a standby mode (e.g., power is supplied to dishwasher 100 but dishwasher is not performing a cycle). Moreover, dishwasher 100 can be operated in a given cycle, including for example, a fill cycle, a circulation cycle, a drain cycle, or a dry cycle. So long as power is supplied to dishwasher 100, method (300) commences at (302). When method (300) commences, dishwasher appliance 100 constantly monitors for flood events. In particular, controller 160 may monitor for flood events by receiving an output signal generated by tub lip sensor 200 continuously at a predetermined interval or time step, such as e.g., every tenth of a second, every half second, every second, etc. Controller 160 can receive the output signals directly or indirectly from tub lip sensor 200.

At (304), method (300) includes determining whether wash fluid is present at or proximate the tub lip at a first time. If wash fluid is detected at or proximate tub lip 170 at the first time, dishwasher appliance 100 is either experiencing or about to experience a flood event. Accordingly, in accordance with exemplary aspects of the present disclosure, corrective action may be taken to prevent or mitigate the impending flood event. As such, the control logic proceeds to (306) so that corrective action may be taken. If wash fluid is not present at or proximate tub lip 170 at the first time, as determined at (304), a flood event is not imminent, and thus, the control logic loops back to (302) to continue monitoring for flood events. The first time is representative of the first time in the control logic that controller 160 checks if wash fluid is present at or proximate tub lip 170. If there is in fact wash fluid at or proximate tub lip 170 at the first time as determined at (304), as will be explained below, controller 160 again checks if wash fluid is present at or proximate tub lip 170 at a second time (i.e., at 310).

In some exemplary implementations at (304), method (300) includes determining, at the first time, whether wash fluid is present at or proximate the tub lip for a predetermined time. The predetermined time may be, for example, between about three (3) and five (5) seconds. Preferably, in some implementations, in determining, at the first time, whether wash fluid is present at or proximate tub lip 170 for the predetermined time, wash fluid must be present at or proximate tub lip 170 consecutively for the predetermined time. Stated alternatively, wash fluid must be detected at or proximate tub lip 170 for the entire predetermined period. In this way, for implementations where tub lip sensor is configured to detect whether wash fluid is present at or proximate tub lip 170, it is less probable or likely that tub lip sensor 200 has been inadvertently or nuisance tripped by splashing wash fluid if wash fluid is required to be present at or proximate the predetermined time or consecutively for the predetermined time.

In some implementations, as noted above, tub lip sensor 200 is configured to detect whether wash fluid is present at or proximate tub lip 170 at the first time. As one example, where tub lip sensor 200 is a conductivity sensor as noted above, to sense wash fluid at or proximate tub lip 170, if tub lip sensor 200 is closed for a consecutive predetermined time (e.g., wash fluid has breached the leads of the sensor for a consecutive period of time), it may be determined that wash fluid is present at or proximate tub lip 170, and thus, it may be determined that a flood event has likely occurred or about to occur. If, however, tub lip sensor 200 remains open or has not closed for a consecutive predetermined time, a determination may be made that wash fluid is not present at or proximate tub lip 170. Consequently, it may be determined that a flood event has likely not occurred or about to occur. Controller 160 may be configured to determine whether or not tub lip sensor 200 is open or closed, and thus whether wash fluid is present at or proximate the tub lip 170.

At (306), method (300) includes activating the drain pump to run a drain cycle if wash fluid is present at or proximate the tub lip at the first time. Stated differently, at (306), corrective action in response to the detected flood event is taken. Preferably, drain pump 168 removes wash fluid from sump 138 and tub 104 at a faster rate than water and/or wash fluid flows into sump 138. In this manner, drain pump 168 can overcome the flow rate of water inlet valve 153, particularly if water inlet valve 153 has failed. Further, in some implementations, drain pump 168 removes wash fluid from sump 138 at twice or at least twice the rate of wash fluid entering sump 138. As one example, drain pump 168 removes fluid from sump 138 at three (3) gallons per minute (gpm) and water inlet valve 153 allows for a flow rate into sump 138 at a flow rate of 0.8 gpm.

In some implementations, at (306), the method (300) includes starting a timer. Preferably, the starting of the timer is coordinated with the activation of drain pump 168. That is, the timer is started upon activation of drain pump 168. The timer can be a component of controller 160 or can be a separate component communicatively coupled with controller 160, for example. The timer is started so that the run time of drain pump 168 may be tracked, among other reasons as will be described herein.

Further, in implementations where dishwasher 100 is performing a cycle, particularly a rinse or wash cycle, additionally or alternatively to activating drain pump 168, at (306), method (300) includes cancelling a current cycle of the dishwasher appliance if wash fluid is present at the tub lip as determined at (304). When wash fluid is detected or determined to be present at tub lip 170, controller 160 effectively determines that a flood event has occurred or is on the verge or precipice of a flood event, as noted above. Thus, equipped with such information, dishwasher 100 can take corrective action to potentially prevent the flood event or reduce the potential damage of the flood event. Cancelling a current cycle of dishwasher appliance 100 may facilitate flood prevention or may mitigate flood damage.

As one example, as noted above, the current cycle being performed by dishwasher appliance 100 can be canceled. For instance, if dishwasher 100 is performing a wash or rinse cycle, to cancel the cycle, method (300) can include deactivating water inlet valve 153 (e.g., closing the valve to a closed position (assuming it is still operable)) to prevent further water from entering dishwasher 100. Moreover, method (300) can likewise include deactivating circulation pump 152. In this way, energy can be conserved and will allow the wash fluid to flow back to sump 138 such that it can be removed from dishwasher 100.

In some further implementations, at (306), method (300) includes logging a flood fault. In this way, if dishwasher 100 is serviced, an operator, service professional, or consumer may quickly ascertain why dishwasher 100 was cancelled mid-cycle. Moreover, in some implementations, as shown at (306), method (300) includes notifying a consumer that the cycle has been cancelled and that a flood event or possible flood event has occurred. For instance, as one example, dishwasher 100 may include a speaker that audibly communicates the notification to a consumer. As another example, dishwasher 100 may include a communication interface that is communicatively coupled with controller 160. The communication interface may include a network interface that provides for communication over a network, such as e.g., a wireless network. In such implementations, dishwasher 100 may send notifications to a consumer's user device, such as e.g., a cell phone.

Further, in some exemplary implementations, at (306), method (300) includes adding one (1) count to a count. For instance, the one count may be a value of one (1) that is added to a counter of controller 160 or a counter that is communicatively coupled with controller 160. As will be explained further below, controller 160 may control various components to take certain actions depending on the current count of counter.

In some exemplary implementations, at (306), method (300) includes setting a pulse flag equal to zero (0). For instance, setting the pulse flag equal to zero (0) may include setting a pulse flag counter of a pulse generator equal to zero (0). The pulse generator may be, for example, a pulse generator circuit in electrical communication with drain pump 168 and/or water inlet valve 153. The pulse flag counter and pulse generator circuit may be onboard controller 160 or may be offboard components.

At (308), method (300) includes ascertaining whether a current time is greater than or equal to a predetermined drain time. For instance, at (308), it is determined whether a current time T is greater than or equal to the predetermined drain time $T_{DRAIN}$. In some implementations, the predetermined drain time $T_{DRAIN}$ is set to correspond with an estimated time in which drain pump 168 should drain dishwasher appliance 100 if drain pump 168 is working properly. For example, the predetermined drain time $T_{DRAIN}$ may be thirty seconds (30 s). The current time T may be kept by the timer. If the current time T is greater than or equal to the predetermined drain time $T_{DRAIN}$, the controller logic proceeds to (310) to see if the wash fluid within tub 104 has actually been drained. If the current time T is not greater than or equal to the predetermined drain time $T_{DRAIN}$, then the controller logic loops back to (308) as shown in FIG. 4A. Notably, the control logic will continue to loop at (308) until the current time T is greater than or equal to the predetermined drain time $T_{DRAIN}$.

At (310), if the current time T is determined to be greater than or equal to the predetermined drain time $T_{DRAIN}$, method (300) includes determining, at the second time, whether wash fluid is present at or proximate the tub lip. By this time (i.e., at the second time), if drain pump 168 is working properly, the wash fluid should be drained from dishwasher appliance 100 such that wash fluid should no longer be present at tub lip 170. This is true even if water inlet valve 153 has failed, as drain pump 168 is preferably configured to drain wash fluid from dishwasher appliance 100 at a faster rate than water may enter dishwasher 100 through water inlet valve 153. As such, if wash fluid is no longer present at or proximate tub lip 170 at the second time, it may be determined that drain pump 168 is working properly and the control logic proceeds to (320). If, however, wash fluid is still present at tub lip 170 after the current time T is determined to be greater than or equal to the predetermined drain time $T_{DRAIN}$, drain pump 168 has very likely malfunctioned or otherwise failed to drain the wash fluid from dishwasher appliance 100. Accordingly, the control logic proceeds to (312) so that corrective action may be taken to attempt to correct the draining issue. The same or similar methods and components used to determine whether wash fluid is present at or proximate tub lip at (304) may be used to determine whether wash fluid is present at or proximate the tub lip at (310).

For instance, in some exemplary implementations at (310), method (300) includes determining, at the second time, whether wash fluid is present at or proximate the tub lip for a predetermined time. That is, in some implementations, at (310) it is determined, at the second time, whether tub lip sensor 200 has sensed wash fluid at or proximate tub lip 170 for a predetermined time. The predetermined time may be, for example, between about three (3) and five (5) seconds. Preferably, in some implementations, in determining whether the tub lip sensor 200 has sensed wash fluid at or proximate tub lip 170 for the predetermined time, wash fluid must be sensed at or proximate tub lip 170 consecutively for the predetermined time. Stated alternatively, tub lip sensor 200 must sense wash fluid at or proximate the tub lip 170 for the entire predetermined period. In this way, it is less probable or likely that tub lip sensor 200 has been inadvertently or nuisance tripped by splashing wash fluid.

At (312), method (300) includes ascertaining whether the pulse flag is less than or equal to a pulse threshold if wash fluid is present at or proximate the tub lip at the second time. That is, if the current time T is greater than or equal to the predetermined drain time $T_{DRAIN}$ and if wash fluid is present at or proximate tub lip 170 at the second time as determined at (308) and (310), respectively, it is determined whether the pulse flag PF is less than or equal to the pulse threshold $P_T$. As one example, the pulse threshold $P_T$ may be set to a value of three (3). Of course, other pulse threshold $P_T$ values are possible. If the pulse flag PF is not less than or equal to the pulse threshold $P_T$, then the control logic proceeds to (316), and in contrast, if the pulse flag PF is less than or equal to the pulse threshold $P_T$, then the control logic proceeds to (314) as shown in FIGS. 4A and 4B.

At (314), if the pulse flag PF is less than or equal to the pulse threshold $P_T$ as determined at (312), method (300) includes pulsing the drain pump. In some instances, debris, such as e.g., olive pits, popcorn kernels, detergent, etc., may clog drain pump 168, preventing drain pump 168 from draining wash fluid from tub 104. For example, debris may clog drain pump 168 so that the impeller blades of the pump cannot turn. By pulsing drain pump 168, drain pump 168 may jolt during the pulses, and in some instances, the debris can become dislodged such that drain pump 168 may resume normal operation, and consequently, drain pump 168 may drain wash fluid from dishwasher 100.

Drain pump 168 may be pulsed in any suitable fashion. As one example, drain pump 168 may be pulsed "on" and "off" rapidly. In some instances, pulsing includes switching drain pump 168 "on" and "off" at a predetermined frequency for a predetermined pulse time (e.g., three seconds (3 s)). As another example, drain pump 168 can remain "on" and a series of square wave electric pulses may be generated by the pulse generator circuit and routed to the drain pump motor to pulse drain pump 168. When the motor is pulsed, the torque on the output shaft of the motor may in turn torque the impeller in such a way that the debris becomes dislodged. In yet other instances, the electronics of drain pump 168 may malfunction or fail. By pulsing drain pump 168, the motor of drain pump 168 may jolt during the pulses. In some instances, pulsing drain pump 168 may electrically revive the motor or other electrical components of drain pump 168 and essentially "kick start" drain pump 168 back into operation.

Further, at (314), in some implementations in addition to pulsing the drain pump, method (300) includes resetting the timer. The timer is reset so that when the control logic loops back to (308) so that drain pump 168 may be activated to run further drain cycles after pulsing, the current time T is refreshed to zero (0). Drain pump 168 is activated for the second and subsequent drain cycles when the control logic returns to (308) as drain pump 168 has not been commanded to deactivate after being activated at (306). Then, as noted above, the current time T is checked against the predetermined drain time $T_{DRAIN}$ of drain pump 168, for a second drain cycle, a third drain cycle, and so on if the wash fluid continues to be present at the second time (i.e., at 310) and the pulse flag PF is less than or equal to the pulse threshold $P_T$.

Moreover, at (314), in some implementations method (300) includes adding a pulse flag count to the pulse flag. In this way, when the control logic loops back to (308) so that drain pump 168 may perform a second drain cycle (or another subsequent drain cycle) and then to (310), if wash fluid is still present at or proximate the tub lip as determined at (310), the value of the pulse flag PF will eventually be greater than the pulse flag threshold $P_T$ as determined at (312). In this way, after a certain number of pulse attempts to revive drain pump 168, either electrically or mechanically, it is determined that pulsing drain pump 168 is simply not correcting the draining issue. Accordingly, if at (312) it is determined that the pulse flag PF is less than or equal to the pulse flag threshold $P_T$, then the control logic proceeds to (316).

At (316), method (300) includes logging a drain fault. The drain fault logged may be indicative that dishwasher 100 is experiencing a flood event, that corrective action was taken to attempt to fix the draining issue, and that the corrective action taken was not successful. The drain fault is logged to assist an operator, service professional, or consumer with taking corrective action. In addition, in some implementations, method (300) includes notifying the consumer that dishwasher 100 is experiencing a flood event, that corrective action was taken (i.e., drain pump 168 was pulsed), and that the corrective action taken was not successful. In this way, a consumer can take necessary corrective actions to prevent dishwasher 100 from flooding. A consumer may be notified in any of the exemplary ways noted above at (306). After logging the drain fault and notifying the consumer at (316), method (300) loops back to (302) where method (300) commences once more.

At (318), method (300) includes resetting the timer. Thereafter, the control logic proceeds to (302) where method (300) repeats to continue monitoring for flood events.

At (320), if no wash fluid is present at or proximate tub lip 170 as determined at (310), method (300) includes deactivating the drain pump. As noted above, if it is determined at (310) that wash fluid is not present at or proximate tub lip 170, then wash fluid is not in imminent danger of spilling over tub lip 170, and accordingly, drain pump 168 is deactivated.

At (322), method (300) includes ascertaining whether the current count is greater than or equal to a count threshold. If the current count is greater than or equal to the count threshold $C_T$, this is an indication that water inlet valve 153 has likely experienced a failure or has in some way malfunctioned. The count threshold $C_T$ may correspond with a value of two (2) or three (3), for example. The counts correspond with the number of times wash fluid is determined to be present at or proximate tub lip 170 at (304). For instance, each time it is determined that wash fluid is present at or proximate tub lip 170 as determined at (304), then at (306) one count is added to the counter, as noted previously. Thus, each time method (300) iterates or repeats and wash fluid is determined to be present at or proximate tub lip 170 at (304), the count value is increased by one (1) each time at (306).

Figure 5:
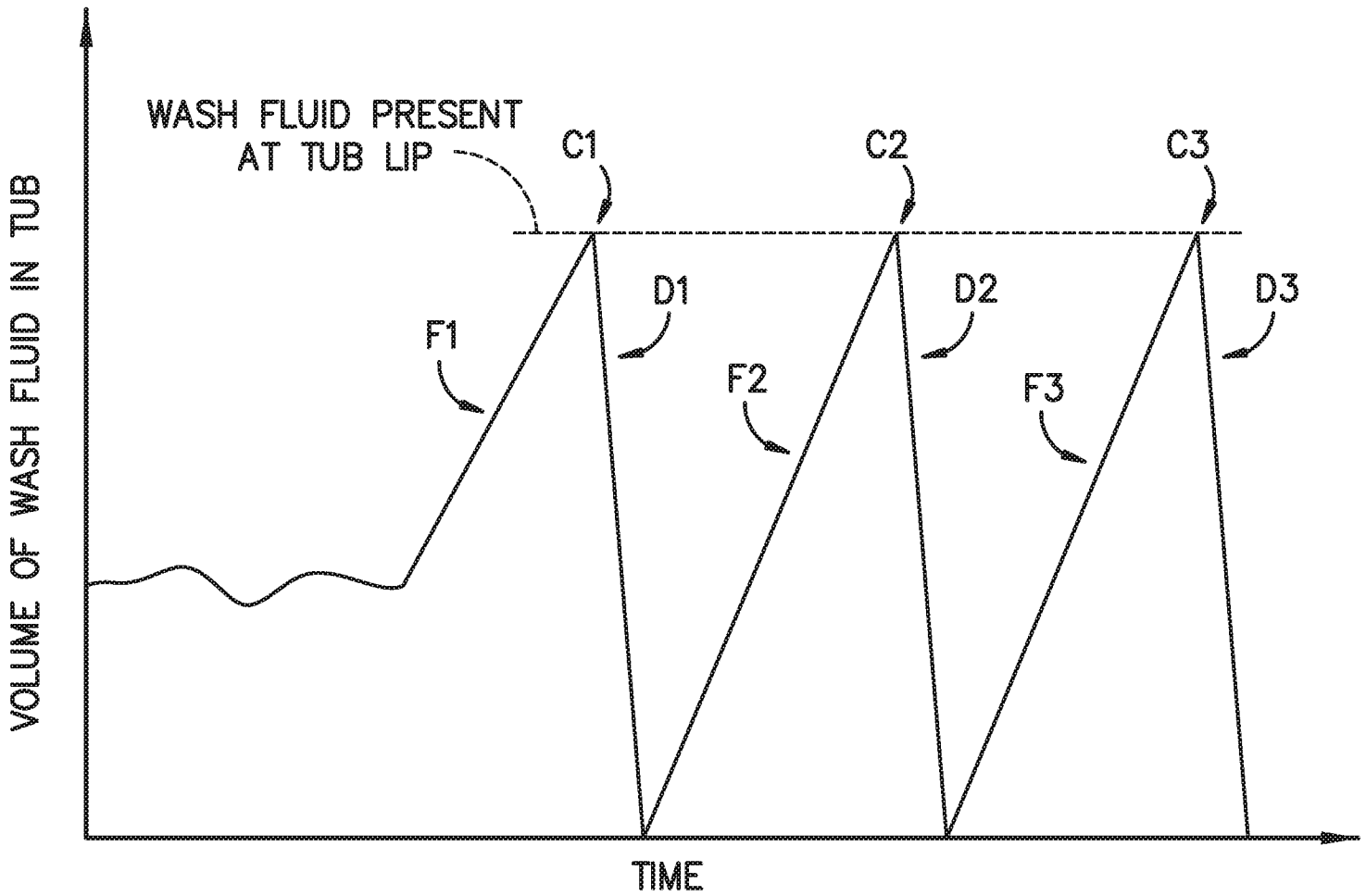
FIG. 5 provides a graph depicting a volume of water within a tub of a dishwasher appliance as a function of time according to exemplary embodiments of the present disclosure.

FIG. 5 provides such a scenario. In particular, FIG. 5 provides a graph depicting the volume of water within tub 104 as a function of time according to exemplary embodiments of the present disclosure. As shown in FIG. 5, in this example, wash fluid was present at tub lip 170 and then was drained by drain pump 168 three (3) consecutive times. That is, dishwasher appliance 100 underwent three (3) separate fill/drain cycles in relatively rapid succession. In particular, as shown in FIG. 5, the volume of wash fluid in tub 104 increased at a relatively constant rate at F1. As wash fluid was detected to be present at or proximate tub lip 170, a first count C1 was added to the counter. As wash fluid was determined to be present at or proximate tub lip 170, drain pump 168 was activated to perform a drain cycle, as represented at D1. As shown, the volume of wash fluid in tub 104 was rapidly removed from tub 104 at D1. However, thereafter, the volume of water in tub 104 increased once again as represented at F2, e.g., due to a water valve failure. A second count C2 was added to the counter the second time wash fluid was detected to be present at tub lip 170. Thereafter, as wash fluid was determined to be present at or proximate tub lip 170 once again, drain pump 168 was activated to perform a drain cycle, as represented at D2. After tub 104 was emptied at D2, the volume of water in tub 104 increased once again, as represented at F3. A third count C3 was added to counter the third time wash fluid was detected to be present at tub lip 170. As wash fluid was determined to be present at or proximate tub lip 170 again, drain pump 168 was activated to perform a drain cycle, as represented at D3. As depicted, each time wash fluid was present at or proximate tub lip 170, one count was added to the counter.

Accordingly, if wash fluid continues to be detected at or proximate tub lip 170 even after drain pump 168 has drained tub 104 on a number of occasions, the current count will eventually be greater than or equal to the count threshold $C_T$ as determined at (322). As recursive filling and draining cycles within a certain period of time is indicative of a water inlet valve failure, dishwasher 100 attempts to take corrective action at (324).

At (324), if the current count is greater than or equal to the count threshold $C_T$ as determined at (322), method (300) includes pulsing the water valve. Stated differently, if it is determined that too many fill and drain cycles have occurred in a certain time frame as represented by the count value, then dishwasher 100 assumes that water inlet valve 153 has failed or has in some way malfunctioned and attempts to take corrective action. Pulsing water inlet valve 153 is one corrective action in which dishwasher 100 may take.

Water inlet valve 153 may be electrically controlled, and accordingly, water inlet valve 153 may be electrically pulsed in attempt to switch the water valve from an open positioned to a closed position. In some instances, various internal components of water inlet valve 153 (e.g., a diaphragm) may become stuck such that water inlet valve 153 remains in an open position, ultimately causing the relatively rapid fill/drain cycles as shown in FIG. 5. Accordingly, by pulsing water inlet valve 153, such internal components may be jolted so that they return to their correct position. Further, in other instances, one or more switching components of the electronics of water inlet valve 153 may become stuck. By jolting water inlet valve 153 via pulses, such switching components may switch to their correct positions. Thus, by pulsing water inlet valve 153, water inlet valve 153 may be modulated to a closed position thereby preventing tub 104 from being filled once again to tub lip 170.

Water inlet valve 153 may be pulsed in any suitable fashion. For example, water inlet valve 153 may be switched "off" and "on" a number of times. In some instances, pulsing includes switching water inlet valve 153 "on" and "off" at a predetermined frequency for a predetermined pulse time. As another example, water inlet valve 153 may remain "on" and a series of square wave electric pulses may be generated by the pulse generator circuit and routed to water inlet valve 153.

Moreover, in some implementations at (324), method (300) includes logging a valve fault. The valve fault is logged to assist an operator, service professional, or consumer with taking corrective action. Additionally, in some implementations at (324), method (300) includes setting the counter equal to zero (0). In this way, water inlet valve 153 will not continue to be pulsed with every successive iteration. However, if method (300) iterates to (322) enough times, eventually the current count will be greater than or equal to the count threshold $C_T$ once again, and accordingly, the control logic will proceed to (324) where water inlet valve 153 will once again by pulsed. Further, in some implementations at (324), method (300) includes resetting the timer. Thereafter, the control logic proceeds to (326).

At (326), method (300) includes determining whether the current time is greater than or equal to a count interval time $T_{COUNT}$. The current time T is checked against the count interval time $T_{COUNT}$ so that water inlet valve 153 is only pulsed when a certain number of counts occur within a certain time frame, i.e., within a particular count interval time period $T_{COUNT}$. Within a particular count interval time period $T_{COUNT}$, the counter continues to accumulate counts each time wash fluid is detected to be present at or proximate tub lip 170 at (304), as one count is added to counter at (306) each time this occurs, as previously described. If the current time, as kept by the timer started at (306), is not greater than or equal to the count interval period $T_{COUNT}$, then the control logic proceeds to (302) with the accumulated count. However, once the count interval time $T_{COUNT}$ ends, i.e., when the current time T is greater than or equal to the count interval time $T_{COUNT}$, the control logic proceeds to (328) where the count is set to zero (0). Thus, for water inlet valve 153 to undergo pulsing at (324), a certain number of fill/drain cycles must occur within a particular time frame.

At (328), method (300) includes setting the count equal to zero (0) if the current time is greater than or equal to the count predetermined drain time $T_{COUNT}$. Thereafter, the control logic proceeds to (302) where method (300) then continues to monitor for flood events.

To further the understanding of the relationship between (304), (306), (322), (324), (326), and (328), examples are provided below. With reference to FIGS. 4 and 5, as a first example, suppose the count time interval $T_{COUNT}$ is set to four (4) minutes and the count threshold $C_T$ is set to a value of three (3). Further suppose that wash fluid is filled and drained in tub 104 as shown in FIG. 5. After tub 104 is filled at F1 to tub lip 170, wash fluid is detected at tub lip 170, and at (306), one count (e.g., C1) is added to counter. Thereafter, wash fluid is drained from tub 104 by drain pump 168 at D1. The control logic will eventually proceed to (322) where it will be determined that the current count is not greater than or equal to the count threshold $C_T$, as the current count is one (1) (e.g., C1) and the count threshold $C_T$ is set at three (3). Suppose the current time T is not greater than or equal to the count time interval time $T_{COUNT}$ at (326) (i.e., suppose the current time is less than four (4) minutes), and accordingly, the control logic proceeds to (302) with one (1) count accumulated and method (300) is repeated. After tub 104 is filled with wash fluid to tub lip 170 at F2, wash fluid is detected at tub lip 170 at (304), and at (306), one count (e.g., C2) is added to counter. Thereafter, wash fluid is drained from tub 104 by drain pump 168 at D2. The control logic will eventually proceed to (322) where it will be determined that the current count is not greater than or equal to the count threshold $C_T$, as the current count is two (2) (e.g., C1, C2) and the count threshold $C_T$ is set at three (3). Suppose the current time T is not greater than or equal to the count time interval time $T_{COUNT}$ at (326) (i.e., suppose the current time is less than four (4) minutes), and accordingly, the control logic proceeds to (302) with two (2) counts accumulated and method (300) is repeated. After tub 104 is filled with wash fluid to tub lip 170 at F3, wash fluid is detected at tub lip 170 at (304), and at (306), one count (e.g., C3) is added to counter. Thereafter, wash fluid is drained from tub 104 by drain pump 168 at D3. The control logic will eventually proceed to (322) where it will be determined that the current count is greater than or equal to the count threshold $C_T$, as the current count is three (3) (e.g., C1, C2, C3) and the count threshold $C_T$ is set at three (3). Thus, the control logic proceeds to (324) and water inlet valve 153 is pulsed and the count is set equal to zero (0), among other things. Thus, on at least the next two successive iterations of method (300), the water inlet valve 153 will not be pulsed.

As a second example, suppose the count time interval $T_{COUNT}$ is set to four (4) minutes, the count threshold $C_T$ is set to a value of three (3), and that wash fluid is filled and drained in tub 104 as shown in FIG. 5. Further, for this example, suppose that the control logic has proceeded as in the example above except as provided below. In particular, suppose that tub 104 is filled with wash fluid to tub lip 170 at F2 and that the wash fluid is detected at tub lip 170 at (304), and at (306), a second count (e.g., C2) is added to counter such that counter has accumulated two counts (C1, C2). However, in this example, at (306), it is determined that the current time T is greater than or equal to the count time interval time $T_{COUNT}$ (i.e., suppose the current time T is greater than or equal to four (4) minutes). Accordingly, the control logic proceeds to (328) where the count is set equal to zero (0). Thus, the accumulated counts (C1, C2) are wiped out, and hence, when control logic proceeds once again through method (300), the counts must be re-accumulated in order for water inlet valve 153 to be pulsed at (324).

Determining whether the current time is greater than or equal to the count interval time $T_{COUNT}$ at (326) thus requires that the counts occur within a certain period of time in order for water inlet valve 153 to be pulsed at (324). Such requirement ensures that water inlet valve 153 is indeed the likely source of the flood event before it is pulsed. In short, on one hand, if a certain number of counts occur close enough in time together as in the first example, it is determined that water inlet valve 153 has likely malfunctioned and thus water inlet valve 153 is pulsed at (324). On the other hand, if a certain number of counts occur but not close enough in time together as in the second example it is determined that water inlet valve 153 has likely not malfunctioned and thus water inlet valve 153 is not pulsed at (324).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method for flood protection of a dishwasher appliance, the method comprising:

determining, by a controller of the dishwasher appliance at a first time, whether a tub lip sensor mounted on a tub lip of a tub positioned within a cabinet of the dishwasher appliance has sensed wash fluid for a first predetermined time, the tub defining a wash chamber for receipt of articles for washing, the dishwasher appliance further having a water inlet valve for selectively allowing wash fluid into the wash chamber, the tub lip sensor being configured to detect wash fluid, the controller being communicatively coupled with the tub lip sensor and the water inlet valve;

activating, by the controller, a drain pump of the dishwasher appliance to run a drain cycle if wash fluid is sensed by the tub lip sensor for the first predetermined time, the drain pump being configured to drain wash fluid from the tub, the controller being communicatively coupled with the drain pump;

ascertaining, by the controller, whether a current time is greater than or equal to a predetermined drain time;

determining, by the controller at a second time, whether the tub lip sensor has sensed wash fluid for a second predetermined time if the current time is greater than or equal to the predetermined drain time; and i) wherein if wash fluid is sensed by the tub lip sensor for the second predetermined time, the method further comprises:

ascertaining, by the controller, whether a pulse flag is less than or equal to a pulse threshold; and pulsing, by the controller, the drain pump if the pulse flag is less than or equal to the pulse threshold; or ii) wherein if wash fluid is not sensed by the tub lip sensor for the second predetermined time, the method further comprises:

deactivating, by the controller, the drain pump;

ascertaining, by the controller, whether a current count is greater than or equal to a count threshold; and pulsing, by the controller, the water inlet valve if the current count is greater than or equal to the count threshold.

2. The method of claim 1, wherein if the pulse flag is not less than or equal to the pulse threshold, the method further comprises:

logging a drain fault.

3. The method of claim 1, wherein during or after pulsing the drain pump, a pulse is added to the pulse flag.

4. The method of claim 1, wherein prior to ascertaining whether the current time is greater than or equal to the predetermined drain time, the method further comprises:

setting a pulse flag equal to zero (0);

wherein during or after pulsing the drain pump, a pulse is added to the pulse flag, and wherein after pulsing, the drain pump is activated to run a second drain cycle.

5. The method of claim 4, wherein after the drain pump is activated for the second drain cycle, the method further comprises:

ascertaining whether the current time is greater than or equal to the predetermined drain time;

determining whether the tub lip sensor has sensed wash fluid at the second time if the current time is greater than or equal to the predetermined drain time;

determining whether the pulse flag is less than or equal to a pulse threshold if the tub lip sensor has sensed wash fluid at the second time; and pulsing the drain pump if the tub lip sensor has sensed wash fluid at the second time and if the pulse flag is less than or equal to the pulse threshold; and repeating the ascertaining, determining, determining, and pulsing of until the pulse flag is not less than or equal to the pulse threshold.

6. The method of claim 1, wherein if the tub lip sensor has sensed wash fluid at the first time, the method further comprises:

canceling a current cycle of the dishwasher appliance.

7. The method of claim 6, wherein canceling comprises deactivating the water inlet valve of the dishwasher appliance.

8. A dishwasher appliance, comprising:

a cabinet;

a tub positioned within the cabinet and defining a wash chamber for receipt of articles for washing, the tub comprising a tub lip;

a tub lip sensor mounted on the tub lip and configured to detect wash fluid;

a water inlet valve for selectively allowing wash fluid into the wash chamber;

a drain pump for draining wash fluid from the tub; and a controller communicatively coupled with the tub lip sensor, the water inlet valve, and the drain pump, the controller configured to:

determine, at a first time, whether the tub lip sensor has sensed wash fluid for a first predetermined time;

activate the drain pump to run a drain cycle if wash fluid is sensed by the tub lip sensor for the first predetermined time;

ascertain whether a current time is greater than or equal to a predetermined drain time;

determine, at a second time, whether the tub lip sensor has sensed wash fluid for a second predetermined time if the current time is greater than or equal to the predetermined drain time; and i) wherein if wash fluid is sensed by the tub lip sensor for the second predetermined time:

ascertain whether a pulse flag is less than or equal to a pulse threshold; and pulse the drain pump if the pulse flag is less than or equal to the pulse threshold; or ii) wherein if wash fluid is not sensed by the tub lip sensor for the second predetermined time:

deactivate the drain pump;

ascertain whether a current count is greater than or equal to a count threshold; and pulse the water inlet valve if the current count is greater than or equal to the count threshold.

9. The dishwasher appliance of claim 8, wherein the controller is further configured to:

add one count to the current count if, at the first time, the tub lip sensor has sensed wash fluid for the first predetermined time, wherein each time the tub lip sensor has sensed wash fluid for the first predetermined time, one count is added to the current count at the first time; and wherein if the current time is greater than or equal to a count interval time, the controller is configured to set the current count equal to zero (0).

10. The dishwasher appliance of claim 8, wherein if the water valve is pulsed, the controller is further configured to log a valve fault, and wherein if the pulse flag is not less than or equal to the pulse threshold, the controller is further configured to log a drain fault.

11. The dishwasher appliance of claim 8, wherein during or after pulsing the drain pump, the controller is further configured to:

add a pulse to the pulse flag.

12. The dishwasher appliance of claim 8, wherein prior to ascertaining whether the current time is greater than or equal to the predetermined drain time, the controller is configured to:

set the pulse flag equal to zero;

add a pulse to the pulse flag during or after pulsing the drain pump; and activate the drain pump to run a second drain cycle after pulsing the drain pump.

13. The dishwasher appliance of claim 12, wherein after the drain pump is activated for the second drain cycle, the controller is configured to:

ascertain whether the current time is greater than or equal to the predetermined drain time;

determine whether wash fluid is sensed by the tub lip sensor at the second time if the current time is greater than or equal to the predetermined drain time;

determine whether the pulse flag is less than or equal to a pulse threshold if wash fluid is sensed by the tub lip sensor at the second time; and pulse the drain pump if wash fluid is sensed by the tub lip sensor and if the pulse flag is less than or equal to the pulse threshold; and repeat ascertaining, determining, determining, and pulsing until the pulse flag is not less than or equal to the pulse threshold.

14. The dishwasher appliance of claim 8, wherein if wash fluid is sensed by the tub lip sensor for the first predetermined time as determined at the first time, the controller is configured to:

cancel a current cycle of the dishwasher appliance.

15. The dishwasher appliance of claim 14, wherein in canceling the current cycle of the dishwasher appliance, the controller is configured to:

deactivate the water inlet valve of the dishwasher appliance.

16. The dishwasher appliance of claim 8, wherein in determining whether wash fluid is sensed by the tub lip sensor at the first time and the second time, the controller is configured to:

determine whether the tub lip sensor has sensed wash fluid consecutively for the first and second predetermined times, respectively.

17. The dishwasher appliance of claim 8, wherein in pulsing the water inlet valve, the controller is configured to:

switch the water inlet valve off and on at a predetermined frequency for a predetermined pulse time.

18. A dishwasher appliance, comprising:

a cabinet;

a tub positioned within the cabinet and defining a wash chamber for receipt of articles for washing, the tub having a tub lip;

a tub lip sensor mounted on the tub lip and configured to detect wash fluid at the tub lip;

a water inlet valve for selectively allowing wash fluid into the wash chamber;

a drain pump for draining wash fluid from the tub; and a controller communicatively coupled with the tub lip sensor, the water inlet valve, and the drain pump, the controller configured to:

determine, at a first time, whether the tub lip sensor has sensed wash fluid at the tub lip for a first predetermined time;

activate the drain pump to run a drain cycle if wash fluid is present at the tub lip for the first predetermined time;

ascertain whether a current time is greater than or equal to a predetermined drain time;

determine, at a second time, whether the tub lip sensor has sensed wash fluid at the tub lip for a second predetermined time if the current time is greater than or equal to the predetermined drain time; and i) wherein if wash fluid is present at the tub lip for the second predetermined time:

ascertain whether a pulse flag is less than or equal to a pulse threshold; and pulse the drain pump if the pulse flag is less than or equal to the pulse threshold; or ii) wherein if wash fluid is not present at the tub lip for the second predetermined time:

deactivate the drain pump;

ascertain whether a current count is greater than or equal to a count threshold; and pulse the water inlet valve if the current count is greater than or equal to the count threshold.

* * * * *